United States Patent [19]

Honkura et al.

[11] Patent Number: 4,969,963

[45] Date of Patent: Nov. 13, 1990

[54] SOFT MAGNETIC STAINLESS STEEL HAVING GOOD COLD FORGEABILITY

[75] Inventors: Yoshinobu Honkura; Eiki Kikuchi; Toyokatsu Usami, all of Aichi, Japan

[73] Assignee: Aichi Steel Works, Ltd., Aichi, Japan

[21] Appl. No.: 289,726

[22] Filed: Dec. 27, 1988

[30] Foreign Application Priority Data

Jun. 30, 1988 [JP] Japan ..... 63-164638

[51] Int. Cl.[5] ..... C22C 38/48

[52] U.S. Cl. ..... 148/307; 148/310; 420/41

[58] Field of Search ..... 148/306, 307, 310; 420/41

[56] References Cited

FOREIGN PATENT DOCUMENTS

| | | | |
|---|---|---|---|
| 463850 | 1/1971 | Japan | 148/306 |
| 52-63813 | 5/1977 | Japan | 148/307 |
| 57-54252 | 3/1982 | Japan | 148/306 |
| 0441344 | 8/1974 | U.S.S.R. | 148/306 |

*Primary Examiner*—Deborah Yee

*Attorney, Agent, or Firm*—Berman, Aisenberg & Platt

[57] ABSTRACT

Soft magnetic stainless steel having good cold forgeability comprising, by weight, less than 0.015% of C, less than 0.20% of Si, less than 0.35% of Mn, less than 0.010% of S, 8 to 13% of Cr, less than 0.020% of Al, less than 0.0070% of O, less than 0.0100% of N and the balance of Fe and inevitable impurities, with a proviso that C+N content is less than 0.020%. The stainless steel can be incorporated additionally at least one of 0.03 to 0.20% of Ti, 0.002 to 0.02% of Ca, less than 0.30% of Bi, less than 0.040% of Se, 0.002% to 0.040% of Te, 0.02 to 0.15% of Zr, less than 2.5% of Mo, less than 0.50% of Cu, less than 0.50% of Ni, less than 0.20% of Nb and less than 0.20% of V. The stainless steel is suitable as magnetic core materials for use in electronic fuel injection devices, electromagnetic valves, magnetic sensors, etc.

9 Claims, No Drawings

SOFT MAGNETIC STAINLESS STEEL HAVING GOOD COLD FORGEABILITY

BACKGROUND OF THE INVENTION

1. Field of the Invention:

The present invention relates to a soft magnetic steel material and, more specifically, it relates to a soft magnetic stainless steel having good cold forgeability together with good magnetic property, electric property, corrosion resistance and machinability which is suitable for material for use in electronic fuel injection devices, solenoid valves, magnetic sensors, etc.

2. Description of the Prior Art:

Heretofore, 0.1%C steels have been used in most of magnetic core materials for use in electronic fuel injection devices, solenoid valves, magnetic sensors, etc., because 0.1%C steels have soft magnetic property to some extent, as well as good cold forgeability that can be cold forged easily even into complicate shapes such as those of parts for the above-mentioned application uses, and production cost and material cost are inexpensive.

On the other hand, there has been a demand in recent years for those steel materials concurrently having the following three characteristics: capability of production in existent fabrication line used for 0.1%C steels, that is, having forgeability as comparable with that of 0. 1%C steels, excellent corrosion resistance and, further, improved magnetic response (compliance of the material to external magnetic fields) in view of the demand for further higher performance. However, these demands can be satisfied only to the following extent by the existent technics at present.

At first, 0.1% C steels are provided with corrosion resistance by applying Ni-P plating after cold forging. Although the materials have excellent cold forgeability (tensile strength 32 kgf/mm$^2$), they involve a drawback, when incorporated as a part in a device and used, in that platings are defoliated to cause clogging in valves during operation of the device to which they are assembled. In addition, the materials have a drawback that the electrical resistance is as low as 15 $\mu\phi$cm and the magnetic response is extremely poor. Further, referring to stainless steels, Fe-13Cr-1Si-0.25Al steels developed in the latter half of 1970's have been used since ten years or so as the materials of excellent cold forgeability. Although the materials have excellent corrosion resistance, high electric resistance and excellent response, the tensile strength is as high as 45 Kgf/mm$^2$ and, accordingly, they can not be compared with 0.1%C steels at all (tensile strength of 32 kgf/mm$^2$, and critical compressibility of 70%). Accordingly, the materials can not be cold forged in the fabrication steps used for 0.1%C steels. Subsequently, although improvement have been tried for the cold forgeability and the electromagnetic properties of 13Cr-1Si-0.25Al steels, those materials having cold forgeability superior to 13Cr-1Si-0.25Al have not yet been developed. In addition, since the material has fatigue strength at welded portion of as low as 25 kgf/cm$^2$, it can not satisfy the required quality of that of greater than 100 kgf/cm$^2$.

SUMMARY OF THE INVENTION

A primary object of the present invention is to provide soft magnetic stainless steel suitable for magnetic core materials for use in electronic fuel injection devices etc.

Another object of the present invention is to provide soft magnetic stainless steel having excellent cold forgeability (e.g. having a tensile strength of less than 36 kgf/mm$^2$ and critical compressibility of greater than 70%) required for magnetic core materials, such as those useful for electronic fuel injection devices, solenoid valves, magnetic sensors, etc..

A further object of the present invention is to provide soft magnetic stainless steel having excellent cold forgeability, showing excellent electric resistance of higher than 40 $\mu\phi$cm, as well as excellent in corrosion resistance, magnetic properties, weldability, machinability and cold forgeability.

The soft magnetic stainless steel according to the present invention is based on the novel finding that has been found as a result of earnest studies made by the present inventors for the effects of various kinds of alloying elements on the cold forgeability, magnetic property, electric resistance and corrosion resistance of conventional soft magnetic stainless steels which are to be described later. To obtain cold forgeability comparable with that of 0.1%C steels by conventional metallurgical methods, martensite structure is formed within the range of the chemical composition of stainless steels. On the other hand, it has been found by the present invention that single ferrite phase stainless steel can be obtained by drastically decreasing the total sum of the carbon content and the nitrogen content in the stainless steels. In single ferrite phase steel in which the total sum of the carbon content and the nitrogen content is drastically decreased, cold forgeability much superior to that expected so far can be obtained by minimizing the amounts of Si, Al, S, O and like other elements each to a limit value, respectively, within the range necessary for the production of steel, thereby conducting purification of steel. Further, since the single ferrite phase can be obtained in the steel by drastically reducing the total sum of the C content and the N content, magnetic properties comparable with those of other soft magnetic stainless steels can be obtained with no particular addition of Si or Al as in conventional steels. Furthermore, by reducing the Al content to less than 0.020% along with a decrease in the content of each of the elements and the purifying treatment, alumina formation during welding can be suppressed to remarkably improve the fatigue strength at the welded portion.

The present invention provides soft magnetic stainless steel having excellent cold forgeability comprising, by weight, less than 0.015% of C, less than 0.20% of Si, less than 0.35% of Mn, less than 0.010% of S, 8 to 13% of Cr, less than 0.020% of Al, less than 0.0070% of O, less than 0.0100% of N, and the balance of Fe and inevitable impurities, with a proviso that the C+N content is less than 0.020%.

The present invention also provides soft magnetic stainless steel having improved machinability and excellent cold forgeability comprising, by weight, less than 0.15% of C, less than 0.20% of Si, less than 0.35% of Mn, 8 to 13% of Cr, less than 0.020% of Al, less than 0.0070% of O, less than 0.0100% of N, a member or members selected from the group consisting of 0.002 to 0.02% of Ca, less than 0.30% of Bi, less than 0.30% of Pb, less than 0.040% of S and less than 0.040% of Se and the balance of Fe and inevitable impurities, with a proviso that the C+N content is less than 0.020% and, further, containing one or more of 0.002 to 0.040% of Te and 0.02 to 0.15% of Zr in case where one or more of S, Se is contained.

Further, the soft magnetic stainless steel for use in cold forging according to the present invention can be improved with the magnetic properties and the cold forgeability by incorporating from 0.03 to 0.20% of Ti, as well as with the corrosion resistance by incorporating a member or members selected from the group consisting of less than 2.5% of Mo, less than 0.50% of Cu, less than 0.50% of Ni, less than 0.20% of Nb and less than 0.20% of V.

The grounds for limitation on the composition of the steel according to the present invention will now be explained below.

C : less than 0.015%

C is an element which impairs cold forgeability due to a solid solution reinforcement effect and adversely affects magnetic properties and, accordingly, it is desirable to reduce the content as low as possible in the present invention, and the upper limit thereof is defined as 0.015%. For further improving cold forgeability and magnetic properties, it is desirably less than 0.010%. The lower limit for C is defined as 0.003%.

Si : less than 0.20%

Si is an element which impairs the cold forgeability due to the solid solution reinforcement effect. Since cold forgeability is considered most important in the present invention, the upper limit thereof is defined as 0.20%, whereas the lower limit thereof is defined as 0.05%.

Mn : less than 0.35%

Since Mn remarkably impairs the corrosion resistance, magnetic property and cold forgeability, it is desirably less than 0.10%. In view of the practical production, the upper limit thereof is defined as 0.35%, while the lower limit thereof is defined as 0.15%.

S : less than 0.010%

S is contained as an impurity in steels but, since this is an element which impairs cold forgeability. The upper limit thereof is defined as 0.010%, while the lower limit thereof is defined as 0.001%.

Cr : 8–13%

Cr is a fundamental element for improving corrosion resistance, electric resistance and magnetic property. Since such effects become insufficient, failing to obtain excellent corrosion resistance and electric resistance unless it is added in excess of 8%, the lower limit thereof is defined as 8%. However, since it impairs magnetic property and cold forgeability if contained in excess of 13% the upper limit thereof is defined as 13%.

Al : less than 0.020%

Al is an element for reinforcement by solid-solubilization, which impairs cold forgeability and weldability. Since it is necessary to be restricted to less than 0.020% in order to obtain fatigue strength of 100 kgf/cm$^2$ at the welded portion, the upper limit thereof is defined as 0.020%. The lower limit for Al is defined as 0.003%.

O : less than 0.0070%

Since O forms an invading type solid-solution to remarkably impair cold forgeability, the content of O is desirably as low as possible. In view of the practical production, the upper limit thereof is defined as 0.007%, while the lower limit thereof is defined as 0.0030%.

N : less than 0.0100%

N is contained as an impurity in steels and, since it is effective for the improvement of cold forgeability and magnetic property by restricting the content to less than 0.0100%. The upper limit thereof is defined as 0.0100%, while the lower limit thereof is defined as 0.0030%.

C+N : less than 0.020%

Both of C and N are elements which remarkably impair magnetic property and corrosion resistance and impair cold forgeability due to the solid solution reinforcement effect. It is an object of the present invention to form an α-single ferrite phase with no addition of Si and Al to attain excellent cold forgeability with the tensile strength of less than 36 kgf/mm$^2$ and the critical compressibility of more than 70% by restricting the content of C+N to less than 0.020%. Accordingly, it is necessary to reduce the amount of C+N to a value as low as possible and the upper limit is defined as 0.020%.

Ti : 0.03–0.20%

Ti is an element which remarkably improves magnetic property, such as the magnetic flux density and the coercive force, as well as fixing C+N into fine carbon nitrides in case where the C+N content is with an extremely low level of less than 0.020%, thereby remarkably improving the cold forgeability such as tensile strength and the critical compressibility. In this meaning, this is an important element in the present invention. For attaining such effect, it is necessary that Ti has to be incorporated at least with 0.03% and, accordingly, the lower limit thereof is defined as 0.03%. However, since the effect is saturated even when Ti is incorporated in excess of 0.20%, the upper limit thereof is defined as 0.20%.

S : less than 0.040%, Se : less than 0.040%

S and Se are added for improving the machinability but since the addition thereof in a great amount impairs the cold forgeability, S is defined as 0.040% for the upper limit and as 0.011% for the lower limit, while Se is defined as 0.040% for the upper limit and as 0.005% for the lower limit.

Pb : less than 0.30%, Bi : less than 0.30%

Bi and Pb are elements which improve the machinability, but since the addition thereof in a great amount impairs cold forgeability, they are defined as 0.30% for the upper limit and as 0.05% for the lower limit, respectively.

Ca : 0.002–0.02%

Ca is added for improving the machinability and it is necessary to add in excess of 0.002% for obtaining the above-mentioned effect. However, since cold forgeability is impaired if it is added in excess of 0.02%, the upper limit thereof is defined as 0.02%.

Te : 0.002–0.040%

Te has an effect of eliminating the undesired effect of S and Se on cold forgeability and it is necessary to incorporate Te in excess of 0.002% in order to obtain the effect. However, since the cold forgeability is rather impaired by the addition of a great amount, the upper limit thereof is defined as 0.040%.

Zr : 0.02–0.15%

Zr is an element which produces spherical MnS grains and improves cold forgeability and it has to be incorporated at least 0.02%. However, since cold forgeability is impaired on the contrary by the addition of a great amount, the upper limit thereof is defined as 0.15%.

Mo : less than 2.5%, Cu : less than 0.50%, p Ni : less than 0.50%, Nb : less than 0.20%, V : less than 0.20%

Mo, Cu, Ni, Nb and V are elements which improve corrosion resistance. However, since magnetic property and cold forgeability are impaired when they are added in excess of 2.5% for Mo, 0.5% for each of Cu and Ni and 0.20% for each of Nb and V, their upper limits are defined as 2.5% for Mo, 0.5% for Cu and Ni, respectively, and 0.20% for Nb and V, respectively.

The lower limits for the elements are defined as 0.05% for Mo, 0.10% for Cu and Ni, respectively and 0.05% for Nb and V, respectively.

DETAILED DESCRIPTION OF THE PREFERRED EMBODIMENTS

The feature of the present invention will be explained more specifically referring to examples in comparison with conventional steels and comparative steels. Table 1 shows the chemical composition in these tested steels.

In Table 1, tested steels Nos. 1, 3 to 6, 8 to 11, 13, 14, 16 to 18, 21 to 25, 27 and 28 are soft magnetic stainless steels according to the present invention. No. 30 is a comparative example of low Cr content, No. 31 is a comparative example of high C, N, Si and Cr contents, No. 32 is a comparative example of high Al content and Nos. 33 and 34 are conventional steels.

For the tested steels shown in Table 1, heat treatment was applied by maintaining them at 900° C. for 2 hours and then cooling at a rate of 100° C./hr and then the tensile strength, critical compressibility, magnetic flux density, coercive force, corrosion resistance, specific resistance and machinability were measured on each example.

The tensile strength was measured by using JIS No. 4 test specimens. The critical compressibility was determined by performing a compression test and measuring the upsetting rate at a 50% cracking rate by using a notched test specimen of 14 mm diameter and 21 mm height, based on the cold upsetting performance test according to the standard (temporary standards) as provided by the Committee of Cold Forging of the Japanese Society of Plastic Rolling.

TABLE 1

| | Chemical composition (wt %) | | | | | | | | |
|---|---|---|---|---|---|---|---|---|---|
| No. | C | Si | Mn | S | Cr | Al | O | N | C + N |
| 1 | 0.004 | 0.15 | 0.21 | 0.003 | 10.23 | 0.003 | 0.0050 | 0.007 | 0.011 |
| 3 | 0.007 | 0.08 | 0.21 | 0.005 | 8.58 | 0.007 | 0.0055 | 0.005 | 0.012 |
| 4 | 0.007 | 0.14 | 0.18 | 0.008 | 11.65 | 0.006 | 0.0065 | 0.006 | 0.013 |
| 5 | 0.008 | 0.12 | 0.20 | 0.006 | 9.35 | 0.007 | 0.0070 | 0.004 | 0.012 |
| 6 | 0.006 | 0.11 | 0.20 | 0.005 | 10.61 | 0.009 | 0.0060 | 0.007 | 0.013 |
| 9 | 0.008 | 0.05 | 0.18 | 0.035 | 11.23 | 0.008 | 0.0060 | 0.006 | 0.014 |
| 10 | 0.007 | 0.09 | 0.20 | 0.005 | 11.65 | 0.005 | 0.0060 | 0.007 | 0.014 |
| 11 | 0.005 | 0.06 | 0.19 | 0.008 | 9.33 | 0.007 | 0.0050 | 0.005 | 0.010 |
| 13 | 0.005 | 0.06 | 0.20 | 0.005 | 10.64 | 0.007 | 0.0070 | 0.004 | 0.009 |
| 14 | 0.006 | 0.06 | 0.21 | 0.006 | 9.55 | 0.008 | 0.0060 | 0.006 | 0.012 |
| 17 | 0.005 | 0.08 | 0.21 | 0.006 | 8.55 | 0.008 | 0.0070 | 0.009 | 0.013 |
| 21 | 0.005 | 0.13 | 0.21 | 0.004 | 10.55 | 0.008 | 0.0050 | 0.006 | 0.011 |
| 22 | 0.004 | 0.08 | 0.21 | 0.006 | 11.27 | 0.005 | 0.0060 | 0.009 | 0.013 |
| 23 | 0.007 | 0.06 | 0.18 | 0.007 | 8.56 | 0.006 | 0.0070 | 0.007 | 0.014 |
| 24 | 0.005 | 0.08 | 0.20 | 0.004 | 10.58 | 0.005 | 0.0060 | 0.007 | 0.012 |
| 25 | 0.008 | 0.06 | 0.22 | 0.005 | 9.66 | 0.008 | 0.0050 | 0.005 | 0.013 |
| 28 | 0.004 | 0.14 | 0.20 | 0.005 | 11.65 | 0.008 | 0.0070 | 0.007 | 0.011 |
| 30 | 0.007 | 0.16 | 0.28 | 0.005 | 6.54 | 0.018 | 0.0080 | 0.006 | 0.013 |
| 31 | 0.020 | 0.35 | 0.27 | 0.004 | 13.20 | 0.010 | 0.0050 | 0.020 | 0.040 |
| 32 | 0.007 | 0.18 | 0.33 | 0.007 | 11.28 | 0.050 | 0.0060 | 0.010 | 0.017 |
| 33 | 0.080 | 0.02 | 0.30 | 0.009 | 0.02 | 0.020 | 0.0110 | 0.020 | 0.060 |
| 34 | 0.01 | 0.95 | 0.32 | 0.010 | 12.06 | 0.240 | 0.0090 | 0.015 | 0.030 |

| No. | Ti | Ca | Bi | Pb | Se | Te | Zr | Mo | Cu | Ni | Nb | V |
|---|---|---|---|---|---|---|---|---|---|---|---|---|
| 1 | | | | | | | | | | | | |
| 2 | | | | | | | | | | | | |
| 3 | | | | | | | | | | | | |
| 4 | 0.08 | | | | | | | | | | | |
| 5 | 0.15 | | | | | | | | | | | |
| 6 | | 0.011 | | 0.25 | | | | | | | | |
| 9 | | 0.008 | | | | | | | | | | |
| 10 | | | 0.15 | | | | | | | | | |
| 11 | | | | 0.18 | | | | | | | | |
| 13 | | | | | 0.024 | | | | | | | |
| 14 | | | | | 0.023 | 0.008 | | | | | | |
| 17 | | | | | | | | 1.23 | | | | |
| 21 | | | | | | | | | | | | 0.08 |
| 22 | | | | | | | | 0.84 | | 0.27 | | |
| 23 | | | | | | | | 2.12 | | | | 0.18 |
| 24 | | | | | | | | | | | 0.15 | 0.11 |
| 25 | 0.12 | | 0.28 | 0.13 | | | | | | | | |
| 28 | 0.18 | 0.014 | | 0.25 | | 0.021 | | 1.52 | | 0.18 | | 0.14 |
| 30 | | | | | | | | | | | | |
| 31 | | | | | | | | | | | | |
| 32 | | | | | | | | | | | | |
| 33 | | | | | | | | | | | | |
| 34 | | | | | | | | | | | | |

For the magnetic property, a ring specimen of 24 mm in outer diameter, 16 mm in inner diameter and 16 mm in thickness was prepared as a test specimen and the magnetic flux density and the coercive force were measured by using a DC type BH tracer.

Referring to the corrosion resistance, saline spray test was conducted using an aqueous 5% NaCl solution to measure the rust forming rate and the evaluation was made as "◎" for less than 5% and " O " those from 5% to 25% with respect to the rust forming rate. The specific resistance was measured according to the Wheatstone bridge method using a wire of 1.2 mm diameter × 500 mm length as a test specimen.

For the machinability, drilling test was conducted by using a test specimen of 10 mm in thickness at a rotational speed of 725 rpm, with drill SKH diameter of 5 mm and under a load of 4 kg, and the time required for drilling was measured.

Table 2 shows the measured tensile strength (kgf/mm$^2$), critical compressibility (%), magnetic flux density ($B_{20}$ (G)); coercive force (He (Oe)), corrosion resistance, specific resistance (μΩcm), machinability (second) and fatigue strength at welded portion (kgf/cm$^2$).

TABLE 2

| No. | Tensile strength (kgf/mm$^2$) | Critical compressibility (%) | Fatigue strength at welded portion (kgf/cm$^2$) | Magnetic flux density B 20 (G) | Coercive resistance Hc (Oe) | Specific resistance (μΩ cm) | Corrosion resistance | Machinability (sec.) |
|---|---|---|---|---|---|---|---|---|
| 1 | 31.0 | 74 | 145 | 13780 | 1.32 | 46 | | 20 |
| 3 | 28.9 | 76 | 130 | 14080 | 1.35 | 41 | Δ | 20 |
| 4 | 31.1 | 74 | 130 | 13550 | 1.28 | 48 | | 20 |
| 5 | 29.3 | 76 | 130 | 13940 | 1.23 | 44 | | 20 |
| 6 | 32.0 | 73 | 125 | 13720 | 1.35 | 46 | | 6 |
| 9 | 31.8 | 73 | 125 | 13640 | 1.40 | 44 | | 8 |
| 10 | 32.6 | 72 | 140 | 13550 | 1.41 | 46 | | 9 |
| 11 | 30.0 | 74 | 130 | 13970 | 1.36 | 42 | | 8 |
| 13 | 32.0 | 73 | 130 | 13750 | 1.37 | 44 | | 10 |
| 14 | 29.4 | 75 | 135 | 13930 | 1.36 | 42 | | 8 |
| 17 | 30.2 | 74 | 130 | 14080 | 1.36 | 41 | | 20 |
| 21 | 31.0 | 74 | 130 | 13730 | 1.34 | 46 | | 20 |
| 22 | 33.1 | 72 | 135 | 13620 | 1.39 | 45 | | 20 |
| 23 | 31.8 | 73 | 135 | 14090 | 1.37 | 40 | | 20 |
| 24 | 31.5 | 74 | 135 | 13740 | 1.36 | 44 | | 20 |
| 25 | 30.7 | 74 | 130 | 13900 | 1.36 | 42 | | 5 |
| 28 | 32.9 | 72 | 130 | 13540 | 1.39 | 48 | | 5 |
| 30 | 30.0 | 75 | 105 | 14370 | 1.45 | 39 | X | 20 |
| 31 | 39.0 | 62 | 110 | 13130 | 1.43 | 51 | | 20 |
| 32 | 33.1 | 72 | 40 | 13560 | 1.33 | 51 | | 20 |
| 33 | 31.2 | 70 | 100 | 15400 | 2.60 | 15 | X | 20 |
| 34 | 44.9 | 45 | 25 | 13040 | 1.10 | 75 | | 8 |

As can be seen from Table 2, the comparative example No. 30 of low Cr content is poor in electric resistance and in corrosion resistance. The comparative example No. 31 of high C, N, Si and C contents are poor in tensile strength, poor in critical compressibility and thereof inferior in cold forgeability, and the comparative example No. 32 of high Al content is inferior in fatigue strength at welded portion.

On the other hand, although the comparative steel No. 33 corresponding to pure iron shows good cold forgeability, it is poor in corrosion resistance and the conventional steel No. 34 corresponding to 13Cr-1Si-0.25Al has a high tensile strength, poor critical compressibility and poor critical strength at welded portion.

On the contrary, Nos. 1, 3 to 6, 8 to 11, 13, 14, 16 to 18, 21 to 25, 27 and 28, as steels according to the present invention, show excellent cold forgeability having tensile strengths of less than 34 kgf/mm$^2$ and critical compressibility of greater than 70%, they additionally show excellent weldability having fatigue strength at welded portion of greater than 110 kgf/cm$^2$, show high electric resistance and corrosion resistance. They are also satisfactory in view of their magnetic properties, by which the effects of the present invention can be confirmed.

As has been described above specifically, the soft magnetic stainless steels for use in cold forging according to the present invention are remarkably improved with cold forgeability while maintaining excellent electric resistance, magnetic properties and corrosion resistance. They are obtained by reducing the amount of Si and Al, and reducing solid solution reinforcing elements, such as C, N and O, to a value as low as possible.

In addition, the machinability is improved without impairing the cold forgeability by adding, in combination, S, Se, Pb, Te, Zr and Ti as required. The present invention provides corrosion resistant soft magnetic steel suitable to magnetic core parts prepared by the cold forging such as for pulse actuated type electronic fuel injection devices, the electromagnetic valves, etc. and have highly practical usefulness.

What is claimed is:

1. Soft magnetic stainless steel having good cold forgeability consisting essentially of, by weight, 0.003 to 0.015% of C, 0.05 to 0.20% of Si, 0.15 to 0.35% of Mn, 0.001 to 0.010% of S, 8 to 11.65% of Cr, 0.003 to 0.009% of Al, 0.0030 to 0.0070% of O, 0.0030 to 0.0100% of N and the balances of Fe and inevitable impurities, with a proviso that C+N content is less than 0.020%; said steel having a tensile strength of less than 36 kgf/mm$^2$, critical compressibility of greater than 70%, and electrical resistance of higher than 40 μΩ cm.

2. The soft magnetic stainless steel as claimed in claim 1 additionally including, by weight, 0.03–0.20% of Ti.

3. The soft magnetic stainless steel as claimed in claim 1 additionally including, by weight, a member or members selected from the group consisting of less than 2.5% of Mo, less than 0.50% of Cu, less than 0.50% of Ni, less than 0.20% of Nb and less than 0.20% of V.

4. The soft magnetic stainless steel as claimed in claim 3 additionally including, by weight, 0.03–0.20% Ti.

5. Soft magnetic stainless steel having good cold forgeability and consisting essentially of, by weight, 0.003 to 0.015% of C, 0.05 to 0.20% of Si, 0.15 to 0.35% of Mr, 8 to 11.65% of Cr, 0.003 to 0.009% of Al, 0.0030 to 0.0100% of N, a member or members selected from the group consisting of 0.002 to 0.02% of Ca, less than 0.30% of Bi, less than 0.30% of Pb, less than 0.040% of S, less than 0.040% of Se, and a member or members selected from the group consisting of 0.002 to 0.040% of Te and 0.02 to 0.15% of Zr where one or more of S and Se is contained, and the balance of Fe and inevitable impurities, with a proviso that C+N content is less than 0.020%; said compressibility of greater than 70% and electric resistance of higher than 40 $\mu\Omega$cm.

6. The soft magnetic stainless steel as claimed in claim 5 additionally including, by weight, 0.03–0.20% of Ti.

7. The soft magnetic stainless steel as claimed in claim 6 additionally including, by weight, a member or members selected from the group consisting of less than 2.5% of Mo, less than 0.50% of Cu, less than 0.50% of Ni, less than 0.20% of Nb and less than 0.20% of V.

8. A soft magnetic stainless steel as claimed in claim 1 which has excellent weldability and a welded-portion fatigue strength of greater than 110 kgf/cm$^2$.

9. A soft magnetic stainless steel as claimed in claim 5 which has excellent weldability and a welded-portion fatigue strength of greater than 110 kgf/cm$^2$.

* * * * *